United States Patent [19]

Mitchell

[11] 4,443,783

[45] Apr. 17, 1984

[54] TRAFFIC LIGHT CONTROL FOR EMERGENCY VEHICLES

[76] Inventor: Wilbur L. Mitchell, 2011 E. 43rd St., Anderson, Ind. 46013

[21] Appl. No.: 481,454

[22] Filed: Apr. 1, 1983

Related U.S. Application Data

[63] Continuation-in-part of Ser. No. 238,044, Feb. 25, 1981, which is a continuation-in-part of Ser. No. 6,351, Jan. 25, 1979, abandoned.

[51] Int. Cl.[3] ..... G08G 1/07

[52] U.S. Cl. ..... 340/32; 340/825.72; 340/825.74

[58] Field of Search ..... 340/32–35, 340/41 R, 43, 44, 696, 825.72, 825.69, 825.74; 455/99, 95, 100, 66, 228, 353

[56] References Cited

U.S. PATENT DOCUMENTS

| | | | |
|---|---|---|---|
| 2,881,409 | 4/1959 | Cook et al. | 340/33 |
| 3,247,482 | 4/1966 | Lesher | 340/32 |
| 3,257,641 | 6/1966 | Campana et al. | 340/32 |
| 3,881,169 | 4/1975 | Malach | 340/32 |
| 4,016,532 | 4/1977 | Rose | 340/32 |
| 4,017,825 | 4/1977 | Pichey | 340/32 |
| 4,059,821 | 11/1977 | Nicholls | 340/44 |
| 4,135,144 | 1/1979 | Elmasian | 340/32 |

*Primary Examiner*—James J. Groody

*Attorney, Agent, or Firm*—Head, Johnson & Stevenson

[57] ABSTRACT

A system for controlling traffic lights to clear intersections in advance of the approach of an emergency vehicle, in which a directional radio transmitter and antenna are provided on the vehicle, which transmits one or the other of two selected coded signals in the direction of movement of the vehicle. An omni-directional radio antenna and receiver are positioned at the intersection to receive the radiated signal from the vehicle approaching that intersection. The first coded signal includes a first pair of frequencies, and the second coded signal includes a different pair of frequencies, which are decoded by two similar pairs of filters. The signals cause a sequence of events including a closing of an interrupter relay which opens all circuits leading from the traffic light controller to all of the traffic lights, and controls the closing, alternately, of two sets of selected circuits, to apply power alternately to two selected sets of traffic lights.

7 Claims, 3 Drawing Figures

TRAFFIC LIGHT CONTROL FOR EMERGENCY VEHICLES

CROSS-REFERENCE TO RELATED APPLICATION

This application is a continuation-in-part of my copending application Ser. No. 238,044, filed Feb. 25, 1981, and entitled "Traffic Light Control for Emergency Vehicles," which is a continuation-in-part of application Ser. No. 6,351, of the same title, filed Jan. 25, 1979 now abandoned.

BACKGROUND OF THE INVENTION

1. Field of the Invention

This invention lies in the field of control devices for traffic lights, so as to modify or change the program of lighting, whenever an emergency vehicle is approaching the intersection at which they are positioned.

More particularly, this invention is related to an apparatus and method of control of the traffic lights at a street intersection, during the time interval that an emergency vehicle is approaching the intersection, and has turned on a unidirectional radio transmitter directed towards the receiver at the intersection.

2. Description of the Prior Art

There is considerable art in this area of emergency control of traffic lights. Some of the systems are operated by acoustical signals from an emergency vehicle, others by light signals, and still others by radio signals. Some of the control systems provide a green light for the traffic approaching the intersection in the direction from which the emergency vehicle is approaching and red in other directions. Others have different systems for lighting the traffic lights and so on. However, the system of this invention is designed to provide the greatest protection to individuals and normal vehicle traffic, and to provide as clear a path as possible for the emergency vehicles, than those shown in the prior art.

SUMMARY OF THE INVENTION

It is a primary object of this invention to provide an apparatus and method for emergency control of traffic lights at a street intersection in which lights are controlled by a customary type of traffic light control (TLC), that is adapted to control RED, AMBER, GREEN, WALK and DON'T WALK lights at an intersection.

It is a further object of this invention to provide an apparatus for emergency control of traffic lights by a control means that opens all circuits from the normal traffic light controller to all of the lights handled by that controller, and to substitute electrical power from a control means that applies the power selectively and alternatively to a first group of lights and then to a second group of lights but not to all of the lights.

It is a still further object of this invention to provide for control of the traffic lights under two different conditions—the first is when the vehicle is approaching the lights with emergency lights and siren on, in which case the radio transmitter is in automatic operation; and the other condition is when the emergency signals are not on, but it is still necessary to control the lights, and the manual switch is closed.

These and other objects realized and the limitations of the prior art are overcome in this invention by providing a radio transmitter in an emergency vehicle that has a directional antenna, which is positioned for radiation in the direction in which the vehicle is moving downline to a street intersection, where the signal lights are positioned. Normally a traffic light controller (TLC) is provided to sequentially light each of the traffic lights in a definite time program. In the vicinity of the traffic lights at the street intersection there is positioned an omni-directional radio antenna and a receiver, the output of which goes to a control circuit.

In the transmitter a plurality of oscillatory signals of selected different frequencies are mixed and used to modulate the radio carrier wave. This radiated signal is then detected at the receiver and is demodulated, and the detected frequencies are then sent to a frequency decoder, which, if the frequencies match, identifies the signal as a valid signal and coming from the emergency vehicle. The control then closes certain circuits to provide power to a first interrupter relay, which disconnects all traffic lights from the TLC. The control then selectively applies power on a pulsating basis to selected ones of the lights at the intersection.

The method of operation involves disconnecting all traffic lights, and then flashing in an on/off manner, sequentially, first the RED signal lights and then the AMBER signal lights and back again to RED lights, and then AMBER, and so on. This type of flashing signal in all directions at a single intersection is novel and is not customary in the normal operation of traffic and therefore can be identified as an emergency signal. This signal would instruct all drivers that an emergency vehicle is in their midst and they should move to the curb and stop as soon as possible. This flashing signal of RED/AMBER/RED, etc. can also include the flashing of the DON'T WALK signal light.

Since the GREEN light and WALK light are disconnected, these lights are permanently dark, and the only signals seen and shown in all directions are the sequentially flashing AMBER, RED, and DON'T WALK lights.

In the emergency vehicle, the radio transmitter is powered from a local power source and in the automatic operation is turned on whenever the emergency siren and flashing red lights are turned on. Thus, when the vehicle emergency signal is on, the frequencies F1 and F2 are transmitted sequentially by the radio transmitter. An additional manual switch is provided, so that a manual control can be placed on the transmission. When the manual control is applied, the frequencies F2 and F3 are transmitted simultaneously, and F1 is off.

In the receiver, alternating frequencies F1 and F2 are detected and identified and are used to control a timer which controls an electric switch, which powers the control mechanism. The timer, once tripped, counts to a selected number of clock periods, say thirty seconds, for example. If the F1, F2 transmission is still continuing at that time, the timer resets itself and goes through a new cycle of counts, and so on. If the transmission of frequencies F1 and F2 terminates, that when the counter reaches the limit of its current count cycle, it opens the electric switch.

The control mechanism also has a means to identify the frequencies F2 and F3. If these are received, they control the electric switch to operate the control mechanism without the timer. In other words, when the manual switch is turned off on the vehicle, the control of the electric switch by the frequencies 2 and 3 terminates.

BRIEF DESCRIPTION OF THE DRAWINGS

These and other objects and advantages of the invention and a better understanding of the principles and details of the invention will be evident from the following description taken in conjunction with the appended drawings in which.

DESCRIPTION OF THE PREFERRED EMBODIMENT

Figure 1:
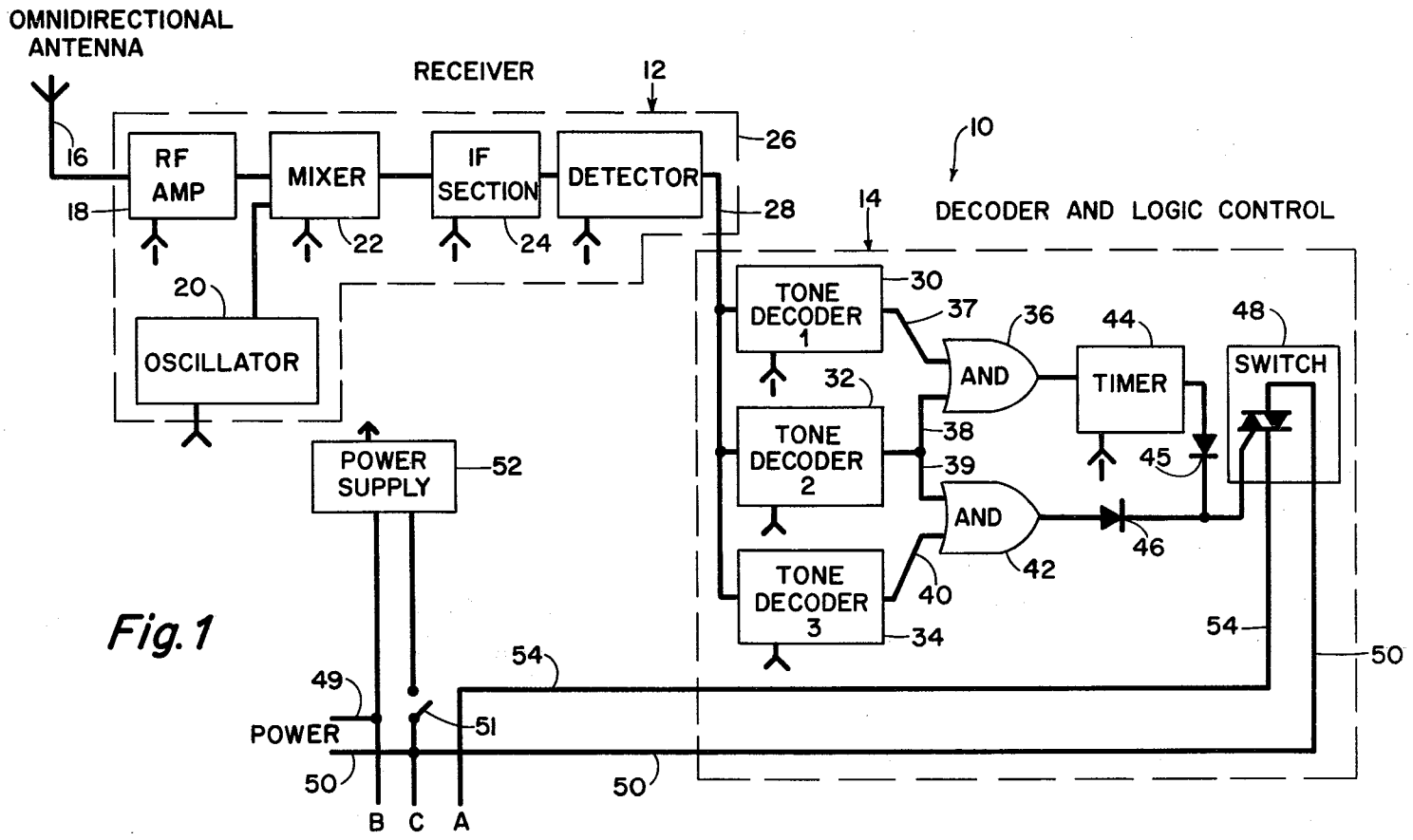
FIG. 1 is a schematic diagram of the radio receiver and control circuitry.

Referring now to the drawings and in particular to FIG. 1, there is shown a block diagram of the radio receiver and control circuitry, indicated generally by the numeral 10. The radio receiver and detector is indicated generally by the dashed box 12. Numeral 14 indicates generally the decoder and logic control circuitry contained within the second dashed outline.

An omni-directional antenna 16 is mounted in the street intersection in the vicinity of the traffic lights, and the radio transmission signal received by the antenna 16 is carried to the radio receiver 12 which is conventional in all respects. The receiver would normally comprise a radio frequency amplifier 18, oscillator 20, mixer 22, IF section 24, and detector 26, all of which are of customary design and well known in the art and need no further description. A power supply unit which provides selected power voltages for the elements of the receiver is indicated by the numeral 52 and is powered by a suitable power source on leads 49 and 50. This power is controlled by switch 51. Such a power supply unit as 52 is also well known in the art and needs no further description.

Figure 3:
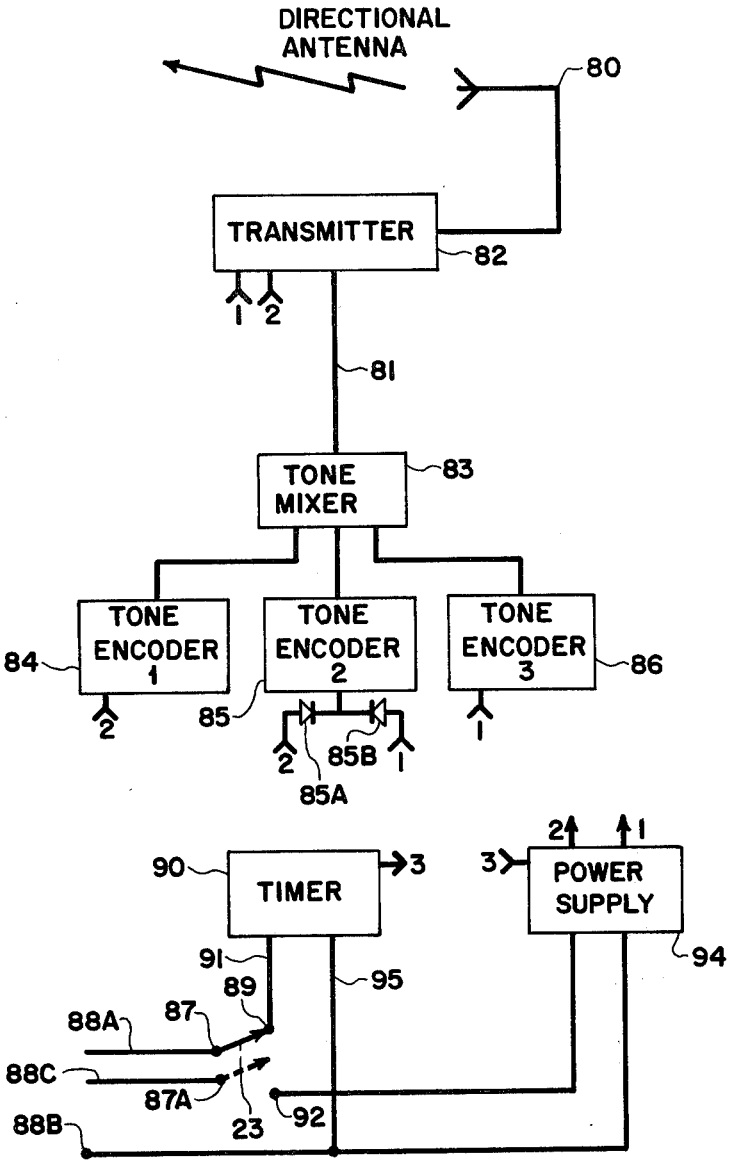
FIG. 3 is a schematic diagram of the radio transmitter system.

Referring briefly to FIG. 3, there is shown a block diagram of the electronic apparatus in the emergency vehicle. This comprises a conventional radio transmitter 82 connected to a directional antenna 80, which is mounted on the vehicle with its direction of propagation, or radiation, in the forward direction of the vehicle. A plurality of oscillators or tone encoders 84, 85, and 86 are shown, each one tuned to a different frequency such as F1, F2, and F3, which are selected for their uniqueness, in the sense that there is a minimum of general electrical noise in those frequency bands. The output signals or tones of these three oscillators or tone encoders are carried to a tone mixer 83 which combines the three frequencies and transmits them over line 81 to the transmitter, which modulates the radio carrier wave. The signal then goes to the antenna 80 and is received at the receiver antenna 16 of FIG. 1. The circuitry of the oscillators or tone controllers 84, 85, and 86 and the mixer 83 are conventional and well known in the art and need no further description.

A power supply 94 is provided with two output voltages identified as 2 and 1. The power voltage 2 powers the tone encoders 84 and 85, and the power voltage 1 controls the tone encoders 85 and 86. Furthermore, the power supply is designed to sequentially generate the tones 84 and 85 which are provided in a pulsating alternating fashion, whereas the tones provided by the tone encoders 85 and 86 would be on continuously. Since two pairs of different frequencies are needed, this can be provided by three different frequencies or, of course, by four different frequencies.

The power source 94 is supplied by power from two different sources. A vehicle source of power 88C, 88B supplies power through double pole single throw switch 23 to the power supply 94 through terminal 92. Power is alternatively supplied through switch 23, from a second source of power 88A, 88B to a timer or automatic pulsing device 90, which supplies power to 94 through lead 3-3.

Power on lead 88A comes from a source of power on the emergency vehicle, which also supplies power to the emergency signals on the vehicle, such as flashing lights, siren, etc. Therefore, when switch 23 is connected to 89, and the emergency lights are on, power is automatically supplied to the timer 90 and to lead 3-3. This provides the pulsating power for the two encoders 84 and 85. The continuous power control for the tone encoders 85 and 86 comes from the power supply 94 over lead 1 and is supplied from the source 88C, 88B through the switch 23 and lead 92. In other words, as the emergency vehicle approaches the intersection where the lights are to be controlled, if it has its emergency lights lighted, then the transmitter will be transmitting pulsating signals from 84 and 85 to the receiver. On the other hand, if the emergency light is not on, no transmission will be made unless the manual switch 23 is closed to 92. In that case, steady tone signals from 85 and 86 are then transmitted through the transmitter and antenna through the receiver 12 of FIG. 1. Tone encoder 85 is provided with diodes 85A and 85B so as to respond separately to the power supply voltages 2 and 1 from 94.

The detected signal from receiver 12 goes by lead 28 to each of the tone decoders 30, 32, and 34 in the decoder and logic control unit indicated by the dashed outline 14. Tone decoders 30 and 32 which represent the frequencies 1 and 2 of FIG. 3 control AND gate 36 through leads 37 and 38, and then to a timer unit 44, which closes a switch 48 for a selected period of time, such as 30 seconds, for example.

While the timer 44 is running, a voltage is applied through the diode 45 to the triac switch 48, which closes the circuit between leads 50 and 54. While a particular switch 48 is shown between leads 50 and 54, this is only by way of example, and any other type of controllable switch, such as relay, can, of course, be used. These are connected to output leads A and C which connect to corresponding leads A and C of FIG. 2. Lead B in FIG. 1 goes from the terminal 49 of the power source, whereas terminal C goes from terminal 50 of the power source. As seen from FIG. 1, there is a voltage between leads B and C equal to that across the power leads 49 and 50. Similarly, there is a voltage between leads A and B equal to the voltage between power leads 49 and 50 only when the switch 48 is closed by a voltage output of the timer through diode 45, or through the operation of the AND gate 42 through the diode 46.

The AND gate 42 is controlled by tone decoders 32 and 34 which operate on frequencies 2 and 3 which are effective whenever the manual switch 23 is closed to 92 of FIG. 3. Tone decoders 32 and 34 control the AND gate 42 over leads 39 and 40.

If the manual switch 23, 92 is not closed, the timer 44 is controlled only by the frequencies 1 and 2 which are transmitted whenever the vehicle emergency lights are on. On the other hand, when the manual switch 23, 92 is closed, frequencies 2 and 3 control the AND gate 42, and control the switch 48 directly. After the radio signal from the receiver terminates, such as when the vehicle moves past the intersection and the transmitting antenna no longer points in the direction of the receiving antenna, the signal disappears from lead 28, and therefore, the control on the AND gate 42 disappears and its output signal opens the switch 48, and conditions are then the same as before the vehicle had approached the intersection.

Figure 2:
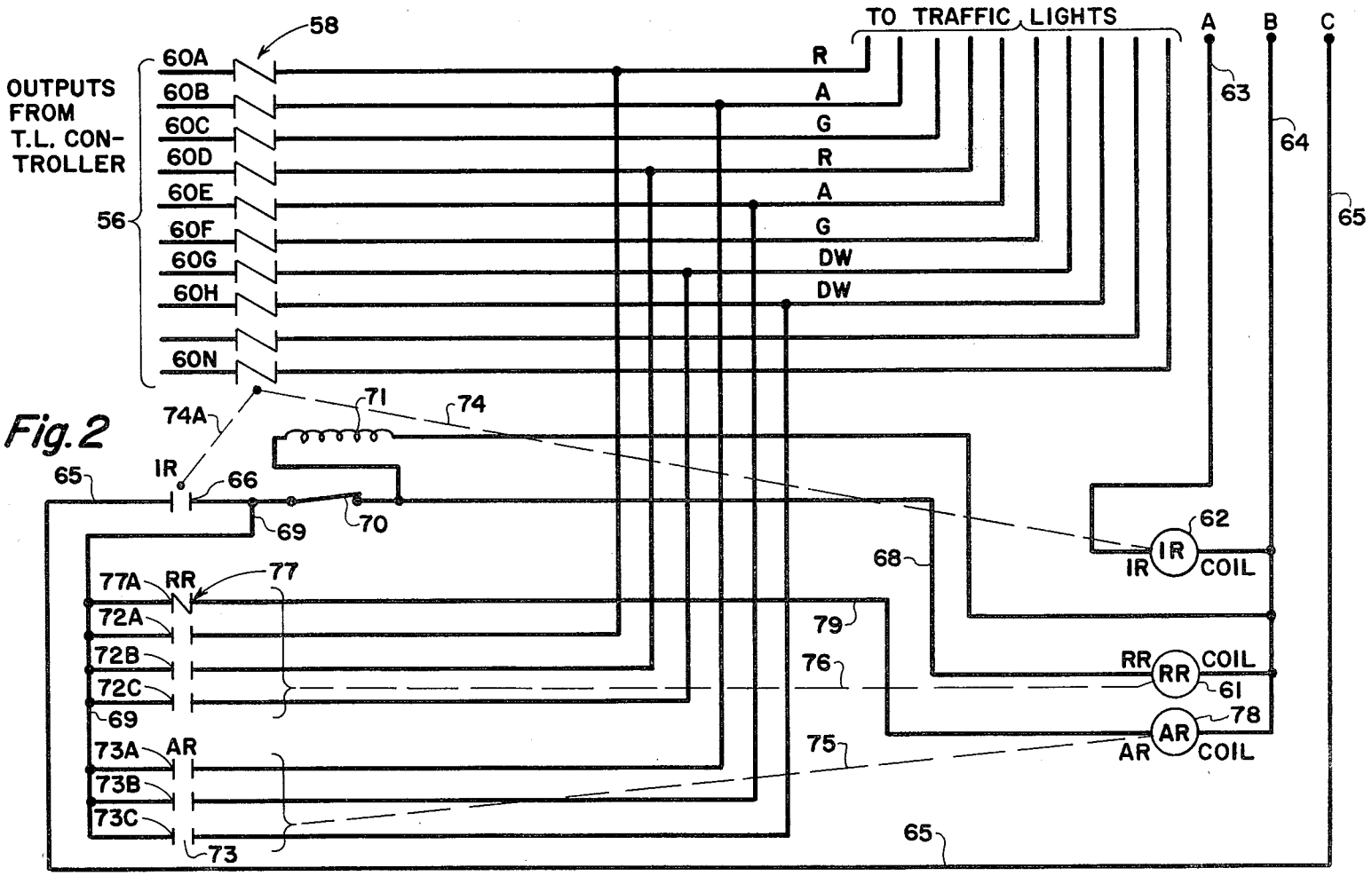
FIG. 2 is a schematic diagram of the light control circuitry.

Referring now to FIG. 2, there is shown one embodiment of a control circuit. An interrupter relay, IR 62, is provided, the coil of which is controlled by the switch 48 through lead A, through the IR coil 62, and through lead 64 back to lead B. The interrupter relay 62 has a plurality of contacts 58 and 66, which are controlled in accordance with the dashed lines 74 and 74A.

The group of contacts 58 are placed one in each of the leads 60A, 60B, 60C, 60D . . . 60N, which are connected from the output terminals of the traffic light controller 56, and go to the traffic lights via leads 60. When the interrupted relay 62 is de-energized, all of the contacts 58 are closed, in which case the traffic lights are powered by leads 60 directly from the traffic light controller 56. When this interrupter relay 62 is de-energized, that is, when there is no received signal, the IR contact 66 which is normally operated through the means 74A is open.

The contact 66, which is a normally open contact on the IR relay, is connected from terminal B though lead 64 through a red relay coil 61, through lead 68, through an on/off flasher 70 of conventional design, through the contact 66, and through the line 65 back to terminal C. In other words, power is supplied from the terminals B and C to the red relay 61 through the contact 66 and the flasher 70.

A group of contacts 77 are mounted on the red relay, whose operating coil is 61, through mechanism indicated by the dashed line 76. One side of each of these contacts is powered by lead 64 from terminal B through lead 68, flasher 70, and lead 69 to a contact 77A, and then through each of their remaining contacts 72A, 72B, 72C which individually goes to one or another of the leads 60. Thus, relay contact 72A, which is normally open, goes to lead 60A to the red lights in one direction of travel. Contact 72B connects with lead 60D, which connects with the red lights in the cross-direction of travel. Contact 72C connects with the DON'T WALK lights in one direction. Thus, the red lights are on in all directions when the red relay 61 is energized through lead 68 and flasher 70.

The contact 77A is normally closed and provides power to the coil AR78 of the amber relay. Of course, this power is provided only when contact 66 is closed by operation of the IR relay 62. Closing contact 66 supplies power from B through coil 78 of the amber relay, contact 77A, contact 66, line 65 to C.

The amber relay AR78 controls contacts 73 through means 75. Contacts 73A, 73B, 73C respectively, which are all normally open, control on lead 60B AMBER lights in one direction, on lead 60E AMBER lights in the cross-direction, and on lead 60H the DON'T WALK lights in the cross-direction. Thus the red and amber relays, operating in an alternating manner, responsive to the timing of the flash 70, controlled by coil 71, control the RED and AMBER lights in an alternating manner.

It will, of course, be clear that other types of flashers, or timers can be used in place of 70,71. Also, other types of light sequences can be used, the RED lights in all directions, then on the next half-cycle, all of the AMBER lights, and so on, is the most effective.

Reviewing the circuitry of FIG. 2, when voltage is supplied to terminal A, it goes by lead 63 to the interrupter relay coils 62 which immediately opens the contacts 58 and closes the contact 66. Closing the contact 66 supplies power from lead 65 and terminal C through relay contact 66, through the flasher 70, and lead 68, to the red relay coil 61 and then back to the terminal B. The action of the flasher 70 is to interrupt the current flowing through the red relay coil 61 on an on/off sequential basis. Thus, the contacts 72 which are controlled by the red relay through means 76 sequentially open and close, open and close, selected ones of the contacts 72 which go to the ALL RED and DON'T WALK lights. Contact 77A, normally closed on the red relay, energizes amber relay 78 only when the red relay is de-energized by the pulsating of flasher 70. This produces the ALL RED, then ALL AMBER flashing program.

The overall action, therefore, is that when an approapriate radio signal is received, the switch 48 closes and immediately removes power from all of the lights at the intersection and immediately initiates a pulsating RED light on each of the RED lights and a pulsating AMBER on each of the AMBER lights which is out-of-phase with the RED lights, so it is RED, AMBER, RED, AMBER, and so on. The DON'T WALK lights are also intermittently powered and can be synchronous with either of the RED or the AMBER lights.

When the manual switch 23, 92 is open, the tone decoders 2 and 3 are turned off, and the AND gate 42 is disabled. If at that time the emergency lights on the vehicle are in operation and the tones 1 and 2 are being transmitted, the AND gate 36 keeps the timer 44 operating, and as long as it operates, it maintains the switch 48 in a closed position to keep the flashing lights going on as in FIG. 2. When the manual switch is opened, the automatic switch 23, 89 is closed and the timer 44 then continues its cycle until at the end of its selected interval it has no further radio signal applied to the AND gate 36. Then it opens the power through diode 45 to the switch 48, which disables the switch 48 and causes the interrupter relay to open, terminating the flashing light connections and closing all contacts 58 to the leads 60 from the traffic light controller 56, which is continuing in its normal cycling operation, and then continues to control traffic on that basis.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. Apparatus for control of traffic lights for passage of an emergency vehicle, comprising:

(a) a conventional traffic light controller (TLC), (b) first means for removing power from said TLC to leads leading to all of the traffic lights under control of said TLC; during at least a first selected time interval;

(c) second means for applying power to selected ones, but not all, of said leads leading to said traffic lights during at least part of said selected time interval;

(d) a directional antenna and radio transmitter connected thereto mounted in an emergency vehicle so as to transmit radiation in the direction in which said vehicle is moving;

(e) an omni-directional antenna and radio receiver means connected thereto mounted at an intersection, for receiving radiation from all directions;

(f) said first and second means responsive to a signal received by said radio receiver means; and in which (g) said radiation transmitted to said receiver means includes at least three tons of different selected frequencies, which are operated as two groups, only one group of which operates at any selected time; one of said two groups comprising a first pair of tones being transmitted alternatey on an on/off cycling; the second group comprising a second pair of tones; of which at least one tone is different from both of said first pair of tones; said second pair being transmitted simultaneously and continuously; and in which (h) said radio receiver means includes means responsive to both of said at least first pair of tones, and to their on/off cycling to control a timer means to close a selected electrical circuit through said timer means for a second selected time interval; and also includes means responsive to both said at least second pair of tones, and to their continuous nature, to by-pass said timer means, and to close said selected electrical circuit directly.

2. The apparatus as in claim 1 in which said second means includes switch means to flash selected traffic lights on and off, while other selected lights are simultaneously flashed on and off.

3. The apparatus as in claim 2 in which said second means provides power successively to the RED lights and then to the AMBER lights in a continuing program of alternation, for said first selected time interval.

4. The apparatus as in claim 3 in which said first selected time interval comprises the time during which said radiation is received by said receiver means plus an additional selected short time interval.

5. The apparatus as in claim 3 in which WALK and DON'T WALK lights are provided, and said second means provides power to said DON'T WALK lights on a similar alternating cycle.

6. The apparatus as in claim 2 in which said second means removes power from GREEN and WALK lights during said selected time interval.

7. The apparatus as in claim 1 in which the transmission of said first pair of tones is responsive to an automatic switch in said emergency vehicle; the transmission of said second pair of tones is responsive to a manual switch; and only one of said automatic and said manual switches being closed at any given time.

* * * * *